United States Patent [19]

Dworak et al.

[11] 3,986,800

[45] Oct. 19, 1976

[54] GEAR TYPE PUMP OR MOTOR WITH RADIAL BALANCING

[75] Inventors: Wilhelm Dworak, Stuttgart; Jürgen Zorn, Korntal; Eugen Hartmann, Weil; Martin Fader, Bieselsberg; Karl-Heinz Müller, Gerlingen; Claus Jöns, Munchingen; Ivan Sauer, Schwieberdingen; Siegfried Mayer, Vaihingen; Jan Vlemmings, Horchdorf, all of Germany

[73] Assignee: Robert Bosch G.m.b.H., Stuttgart, Germany

[22] Filed: Apr. 9, 1975

[21] Appl. No.: 545,035

[30] Foreign Application Priority Data

Mar. 11, 1974 Germany ..... 2411492

[52] U.S. Cl. ..... 418/74; 418/126; 418/132

[51] Int. Cl.[2] ..... F01C 21/00; F03C 3/00; F04C 15/00; F01C 19/04

[58] Field of Search ..... 418/71, 74, 126, 129, 418/131, 132, 125

[56] References Cited

UNITED STATES PATENTS

| | | | |
|---|---|---|---|
| 1,937,367 | 11/1933 | Vickers | 418/74 |
| 2,212,994 | 8/1940 | Vrolix | 418/74 |
| 2,808,007 | 10/1957 | Gaubatz | 418/74 |
| 2,993,450 | 7/1961 | Weigert | 418/71 |
| 2,996,999 | 8/1961 | Trautman | 418/126 |
| 3,381,619 | 5/1968 | Mingot | 418/74 |
| 3,847,519 | 11/1974 | Dworak et al. | 418/126 |

*Primary Examiner*—John J. Vrablik
*Attorney, Agent, or Firm*—Michael J. Striker

[57] ABSTRACT

An external gear pump wherein the gears are installed in an eight-shaped compartment of a central housing section which is flanked by two covers. The outlet port of the housing communicates with two arcuate recesses for metallic inserts which are biased against the adjacent gears by fluid pressure in the outlet port whereby the inserts urge the gears against those portions of the internal surface of the central housing section which are located opposite the recesses. Such portions of the internal surface are formed with narrow first cutouts which communicate with the outlet port. The internal surface is further formed with relatively wide additional cutouts which are located between the first cutouts and the recesses and communicate with the inlet port. The force which is produced by fluid in the cutouts opposes the force which urges the gears against the internal surface of the central housing section to thus reduce the force with which the stubs of the gear shafts are urged against the housing.

5 Claims, 5 Drawing Figures

GEAR TYPE PUMP OR MOTOR WITH RADIAL BALANCING

BACKGROUND OF THE INVENTION

The present invention relates to hydraulic machines in general, and more particularly to improvements in external gear type pumps or motors.

In an external gear pump or motor, the stubs of the gears are received in bores, bearing sleeves or eight-shaped bearing members of the housing. It is already known to provide the housing of an external gear type pump with two recesses communicating with the outlet port and receiving relatively narrow inserts which are subjected to the pressure of fluid in the outlet port and urge the gears against the internal surface of the housing. The inserts normally consist of a suitable metal (e.g., sheet metal) and serve to establish desirable metallic seals for the paths wherein the fluid is conveyed from the inlet port toward the outlet port.

A drawback of presently known external gear pumps which embody the just discussed inserts is that the inserts transmit substantial forces which cause the teeth of the respective gears to bear against the internal surface of the housing with attendant pronounced wear upon the housing and gear teeth. Moreover, such substantial forces are transmitted to those surfaces of the housing which surround the stubs of the shafts for the mating gears. The resulting wobbling affects the output of the machine and the bearing surfaces for the stubs are subjected to excessive wear. Consequently, such surfaces must be provided on parts which consist of expensive highly wear-resistant material and the dimensions of the housing must be increased for the express purpose of insuring that the bearings for the stubs will exhibit a requisite resistance to stresses which are being transmitted by the gears in response to transmission of hydraulic forces via inserts in the region of the outlet port.

SUMMARY OF THE INVENTION

An object of the invention is to provide a novel and improved external gear type hydraulic machine which can be used as a pump or motor and wherein the magnitude of stresses upon the bearing surfaces for the shafts of mating gears is a small fraction of those in conventional machines.

Another object of the invention is to provide a novel and improved housing for an external gear type pump or motor.

A further object of the invention is to provide the housing with novel and improved means for effectively resisting stresses which are transmitted to the housing by gear teeth as a result of engagement of gear teeth with mobile inserts which are installed in the housing in the region of the high-pressure port for oil or another hydraulic fluid.

An additional object of the invention is to provide an external gear type pump or motor wherein the useful life of component parts greatly exceeds the useful life of such parts in a conventional machine, whose output is higher than that of similarly dimensioned conventional machines, and which can employ a relatively compact and lightweight housing.

Still another object of the invention is to provide an external gear pump or motor wherein the forces which the shafts of the gears transmit to their bearings are only a minute fraction of forces which act upon the gears and wherein the magnitude of forces acting upon the bearings can be selected in advance with a high degree of accuracy and reproducibility.

The invention is embodied in an external gear type hydraulic machine, particularly in a pump, which comprises a housing having a preferably eight-shaped compartment bounded by an internal surface, high- and low-pressure ports communicating with the compartment and being preferably coaxial with each other, and first and second recesses provided in the internal surface adjacent to and in communication with the high-pressure port. The machine further comprises mating first and second gears which are rotatable in the compartment and each of which has two coaxial stubs journalled in the housing. The first and second recesses are respectively adjacent to the first and second gears and each thereof extends circumferentially of the respective gear along an arc which is preferably less than 90 degrees. The machine also comprises preferably metallic first and second inserts which are movably mounted in the first and second recesses and bear against the first and second gears under the action of pressurized fluid in the high-pressure port to thereby urge the gears against the internal surface of the housing. The internal surface has first and second cutouts which are respectively disposed opposite the first and second recesses with respect to the axes of the first and second gears and communicate with the high-pressure port so that the pressure of fluid in such cutouts generates a force which opposes the force to which the gears are subjected by the respective inserts. This reduces the forces with which the stubs of the gears bear against the housing.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
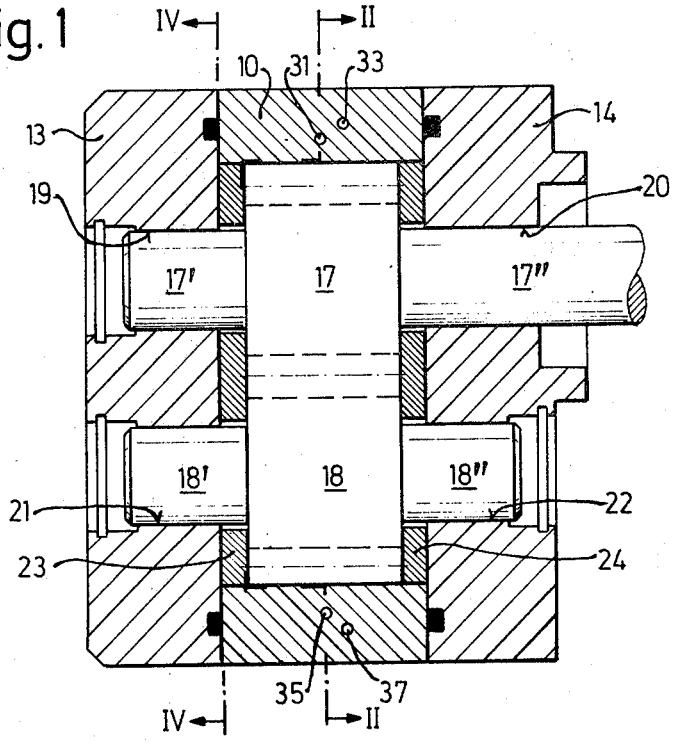
FIG. 1 is a central longitudinal sectional view of an external spur gear type hydraulic machine which embodies the invention.
Figure 2:
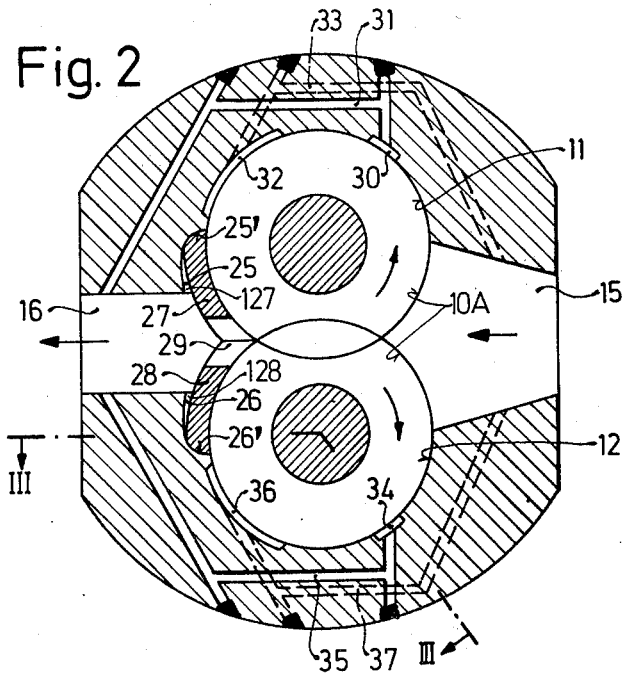
FIG. 2 is a sectional view as seen in the direction of arrows from the line II—II of FIG. 1.

Referring first to FIGS. 1 and 2, there is shown an external spur gear hydraulic machine having a housing which includes a central or main section 10 and two covers 13, 14 which are adjacent to the opposite sides of the central section and are secured thereto by bolts or analogous fastener means, not shown. The central section 10 has two partially overlapping bores 11 and 12 which extend between its end faces and define an eight-shaped compartment for two mating spur gears 17, 18. The central housing section 10 is further formed with a first port 15 and a second port 16 which latter is located opposite and is preferably coaxial with the port 15. One of the ports 15, 16 communicates with the eight-shaped compartment in the region where the teeth of the gears 17, 18 move out of mesh with each other and the other of these ports communicates with the compartment in the region where the teeth of the gears 17, 18 move into mesh with each other. The illustrated machine is assumed to operate as a pump; therefore, the port 15 is the inlet port or low-pressure port and the port 16 is the outlet port or high-pressure port. The inlet port 15 is assumed to be connected to a reservoir supply line (not shown), and the outlet port 16 is assumed to be connected to a consumer by a pressure line (not shown).

The shaft for the spur gear 17 has two coaxial stubs 17′, 17″ which respectively extend into bores 19, 20 provided therefor in the covers 13, 14. The stub 17″ is driven by a suitable prime mover (not shown), i.e., it constitutes the input element of the pump. The shaft of the gear 18 has two coaxial stubs 18′, 18″ which respectively extend into bores 21, 22 provided therefor in the covers 13 and 14.

The axial length of mating gears 17, 18 is somewhat less than the thickness of the central housing section 10 (as considered in the axial direction of the stubs 17′, 17″, 18′, 18″). Thus, the gears 17 and 18 provide in the compartment space for two metallic wearing plates 23, 24 which are respectively adjacent to the inner sides of the covers 13, 14. The outlines of the plates 23, 24 match exactly or very closely the outline of the surface 10A which bounds the compartment (bores 11 and 12) in the housing section 10. The plates 23, 24 flank the gears 17 and 18, i.e., their inner sides are adjacent to the respective end faces of the gears.

The surface 10A of the housing section 10 is formed with two preferably mirror symmetrical recesses 25, 26 which respectively communicate with the bores 11, 12 and are also in communication with the outlet port 16. Each of the recesses 25, 26 extends in parallelism with the axes of the bores 11, 12, i.e., between the two end faces of the housing section 10. The depth of the recesses 25, 26 (as considered in the radial direction of the respective gears) decreases in wedge-like fashion in a direction away from the axis of the outlet port 16, as considered in the circumferential direction of the respective gears 17, 18. It will be noted that the depth of the recess 25 decreases counter to the direction of rotation of the gear 17 (this gear is assumed to be driven counterclockwise, as viewed in FIG. 2) and that the depth of the recess 26 decreases counter to the direction of rotation of the gear 26 (the gear 26 is driven by the gear 17 to rotate clockwise, as viewed in FIG. 2). The surfaces bounding the recesses 25, 26 have rounded end portions 25′, 26′ which are remote from the axis of the outlet port 16.

The recesses 25, 26 respectively receive arcuate metallic inserts 27, 28 each of which has a concave surface adjacent to the respective spur gear and a convex surface which abuts against the rounded end portion (25′, 26′) of the surface bounding the respective recess. The inserts 27, 28 may be made of sheet metal and may have a substantially constant thickness, as considered in the radial direction of the respective gears. Consequently, each of the inserts 27, 28 defines with the surface bounding the respective recess 25, 26 a substantially wedge-shaped clearance or gap (shown in FIG. 2 at 127 and 128) whose width increases from the respective surface portion 25′, 26′ toward the axis of the outlet port 16. The inserts 27, 28 further have third surfaces which may be flat and which abut against each other in the plane of the common axis of the ports 15, 16, i.e., in the plane where the pitch circles of teeth of the spur gears 17, 18 contact each other.

Due to their just described configuration, the concave surfaces of the inserts 27, 28 normally abut against the respective gears 17, 18 even if the pump is not in use, i.e., even if the pressure in the outlet port 16 does not exceed the pressure in the inlet port 15. The aforementioned third surfaces of the inserts 27, 28 are grooved to define a passage 29 which allows pressurized hydraulic fluid to flow into the outlet port 16. Such fluid is pressurized on its way from the inlet port 15, in the spaces between the teeth of gears 17, 18 (i.e., along the corresponding portions of the internal surface 10A) and to the passage 29. The length of the inserts 27, 28, as considered in the circumferential direction of the respective gears 17, 18, is not more and preferably less than one-fourth of the circumference of the respective gears.

The internal surface 10A of the central housing section 10 is formed with a relatively narrow and relatively shallow cutout or depression 30 which is located substantially diametrically opposite the recess 25 (with respect to the common axis of the gear 17 and bore 11). The cutout 30 extends in parallelism with the axis of the gear 17 and its length equals the axial length of this gear. A channel 31 connects the cutout 30 with the outlet port 16.

The internal surface 10A of the housing section 10 is further formed with a relatively wide and relatively shallow second cutout or depression 32 which is adjacent to the recess 25 and also extends in parallelism with the axis of the gear 17. The length of the cutout 32 matches that of the cutout 30, i.e., the axial length of the gear 17. A channel 33 connects the cutout 32 with the inlet port 15.

The internal surface 10A of the section 10 is further formed with two additional cutouts 34 and 36 which respectively correspond to the cutouts 30, 32 and are adjacent to the gear 18. The width of the cutout 36 exceeds that of the cutout 34; each of these cutouts extends in parallelism with the common axis of the bore 12 and gear 18; and the length of each of these cutouts matches the axial length of the gear 18. The cutout 34 is located substantially diametrically opposite the recess 26 and the cutout 36 is rather closely adjacent to the recess 26. The cutout 34 communicates with the outlet port 16 via channel means 35, and the cutout 36 communicates with the inlet port 15 via channel means 37. The dimensions of the cutouts 34, 36 preferably match those of the cutouts 30, 32, i.e., the cutouts 30, 34 are narrower than the cutouts 32, 36.

Figure 3:
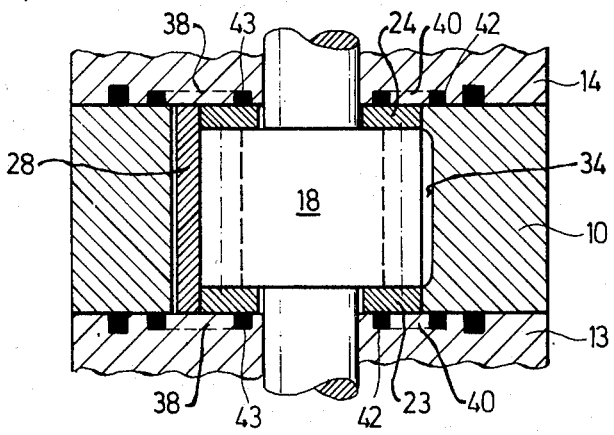
FIG. 3 is a sectional view as seen in the direction of arrows from the line III—III of FIG. 2.
Figure 4:
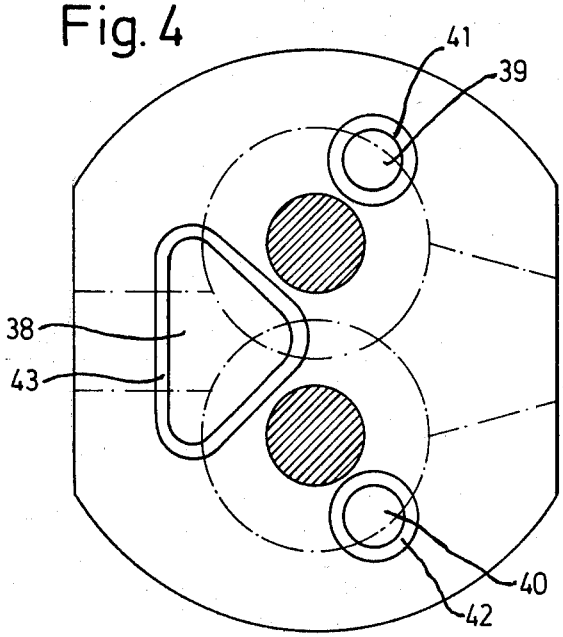
FIG. 4 is a sectional view as seen in the direction of arrows from the line IV—IV of FIG. 1.

FIGS. 3 and 4 shown pressure fields which develop between the covers 13, 14 and the adjacent wearing plates 23, 24. The pressure fields 39 and 40 which develop between the covers 13, 14 and plates 23, 24 have a circular outline and are respectively in line with the cutouts 30 and 34 in the internal surface 10A of the section 10. Two substantially triangular pressure fields 38 develop between the covers 13, 14 and plates 23, 24 in line with the recesses 25, 26. Each pressure field 38 is in direct communication with the outlet port 16 and is bounded by a discrete sealing element 43. The circular pressure fields 39, 40 are respectively surrounded by sealing elements in the form of O-rings 41, 42. These circular pressure fields 39, 40 respectively communicate with the cutouts 30, 34.

The axial length of inserts 27, 28 may be slightly less than the axial length of the gear 17 or 18 plus the combined thickness of wearing plates 23, 24.

When the machine is operated as a pump, the prime mover rotates the stub 17'' to drive the spur gear 17 counterclockwise, as viewed in FIG. 2, whereby the gear 17 drives the gear 18 in a clockwise direction. The pump draws hydraulic fluid via inlet port 15 and such fluid enters the spaces between the teeth of gears 17, 18 to be conveyed along the respective portions of the internal surface 10A on its way toward the passage 29. The latter admits pressurized fluid into the outlet port 16 so that the pressurized fluid can flow into and can operate one or more consumers (e.g., one or more cylinder and piston units, now shown).

Figure 5:
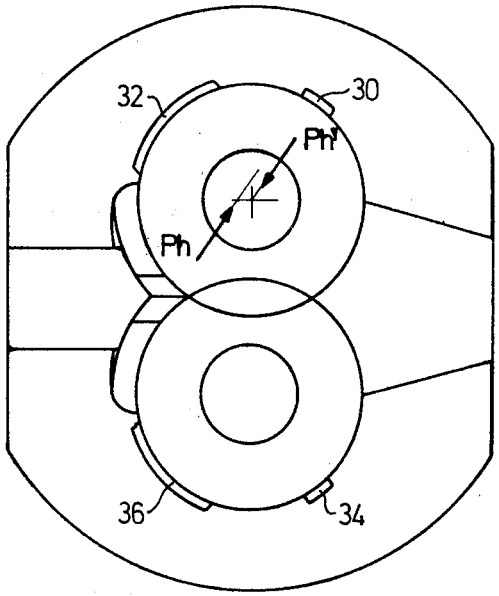
FIG. 5 is a diagrammatic view which is similar to the sectional view of FIG. 2 and shows the directions in which the forces act upon one of the gears and upon the adjacent portion of the housing.

The highly pressurized fluid which fills the outlet port 16 penetrates into the clearances 127, 128 and urges the concave surfaces of the inserts 27, 28 against the respective gears 17, 18. The hydraulic force p*h* which acts against the gear 17 as a result of elevated fluid pressure in the outlet port 16 is shown in FIG. 5; a similar hydraulic force acts upon the gear 18. The force P*h* urges the concave surface of the insert 27 into sealing engagement with the adjacent teeth of the gear 17 and causes the generation of a pressure zone between 17 and 27. The force p*h* is large enough to urge the teeth of the gear 17 against the internal surface 10A in a region which is located substantially diametrically opposite the insert 27, i.e., in the region of the cutout 30. This causes a slight penetration of the teeth of gear 17 into the surface 10A in the region of the cutout 30. Also, the teeth of the gear 17 penetrate slightly into the concave surface of the insert 27 in the recess 25. In other words, when the pump is in use, there develops a first seal between the surface 10A and the gear 17 (in the region of the cutout 30) and a second seal between the gear 17 and the insert 27.

The situation is analogous in the bore 12, i.e., the teeth of the gear 18 penetrate slightly into the surface 10A in the region of the cutout 34 and into the concave surface of the insert 28 to form two seals which are located substantially diametrically opposite each other.

The cutouts 30, 34 communicate with the outlet port 16 via channels 31 and 35. Consequently, the zones 39, 40 contain highly pressurized hydraulic fluid. The zones 38 also contain highly pressurized fluid because each thereof communicates directly with the outlet port 16. The pressure fields 38, 39 and 40 insure that the plates 23 and 24 are maintained in satisfactory sealing engagement with the respective end faces of the gears 17, 18 because these fields develop between the plates 23, 24 and the covers 13, 14.

Were the forces which the inserts 27, 28 respectively transmit to adjacent teeth of the gears 17, 18 unopposed, the stubs 17', 17'' and 18', 18'' would bear with a substantial force against the surfaces surrounding the respective bores 19, 20 and 21, 22 of the covers 13 and 14. In accordance with a feature of the invention, the just mentioned forces are opposed by forces which are generated by fluid in the cutouts 30, 32 and 34, 36. As shown is FIG. 5, the force p*h* which acts upon the gear 17 is opposed by a force P*h'* Which is the sum of forces produced by fluid in the cutouts 30, 32 and whose magnitude is only slightly less than that of the force P*h.* Consequently, the force $\Delta$ P*h* which acts upon the surfaces bounding the bores 19 and 20 of the covers 13 and 14 equals P*h* − P*h'*. By properly dimensioning the cutouts 30 and 32, one can select the magnitude of the force $\Delta$ P*h* with a high degree of accuracy to thus insure that the stresses upon the bearing surfaces for the stubs 17', 17'' do not exceed a preselected maximum permissible value. The situation is analogous with the forces which act upon the gear 18, its stubs 18', 18'' and the surfaces bounding the bores 21, 22 of the covers 13, 14.

The illustrated external spur gear machine is a so-called plate pump because its housing is assembled of three substantially plate-like components or sections 10, 13 and 14. However, the invention can be embodied with equal advantage in hydraulic machines whose housings are constructed and assembled in a different way, for example, wherein the housing comprises discrete bearing sleeves or eight-shaped bearing members for the stubs of spur gears, helical gears or otherwise configurated mating gears. Each of the plates 23, 24 may constitute an eight-shaped bearing member for two of the four stubs. Since the forces which are transmitted to the bearings for the shafts of the gears are relatively small, the improved machine can be provided with a relatively compact and lightweight housing. Also, the machine can be operated as a motor having a high starting torque owing to negligible friction between the gear shafts and the bearing surfaces in the housing.

The sealing action of inserts 27, 28 is just as satisfactory as in heretofore known external gear type machines; in fact, the provision of cutouts in the internal surface can enhance the sealing action in a direction toward the inlet port. Such improved sealing action can be achieved irrespective of whether the shafts of the gears are journalled directly in the covers of the housing or in bearing sleeves or otherwise configurated bearing members which are axially movably mounted in the housing proper.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. In an external gear type hydraulic machine, particulary in a pump, a combination comprising a housing having a compartment, an internal surface bounding said compartment, high- and low-pressure ports communicating with said compartment, and first and second recesses provided in said surface adjacent to and in communication with said high-pressure port; mating first and second gears in said compartment, each of said gears having two coaxial stubs journalled in said housing and said first and second recesses being respectively adjacent to said first and second gears and each extending circumferentially of the respective gear along an arc of less that 90°; and first and second inserts movably mounted in said first and second recesses and bearing against said first and second gears to thereby urge said gears against said internal surface, said surface further having first and second cutouts respectively disposed opposite said first and second recesses with respect to the axes of said first and second gears and communicating with said high-pressure port, a third cutout communicating with said low-pressure port and disposed between said first recess and said first cutout; and a fourth cutout communicating with said low-pressure port and disposed between said second recess and said second cutout; said third and fourth cutouts being closely adjacent to said first and second recesses and having a width, as considered in the circumferential direction of said gears, which exceeds the width of said first and second cutouts.

2. A combination as defined in claim 1, wherein each of said inserts consists of metal and has a concave surface conforming to the outline of the adjacent portion of the respective gear.

3. A combination as defined in claim 1, wherein said housing has bores for said stubs and said compartment is eight-shaped.

4. A combination as defined in claim 1, wherein said housing includes wearing plates disposed in said compartment and flanking said gears, and further comprising means defining pressure fields disposed between said wearing plates and said housing to urge said plates against said gears.

5. A combination as defined in claim 4, wherein each of said inserts has a length, as considered in the axial direction of said gears, which is slightly less than the axial length of a gear plus the combined thickness of said plates.

* * * * *